United States Patent [19]

Takahashi

[11] 4,406,549

[45] Sep. 27, 1983

[54] ELECTRONIC TIMEPIECE WITH ALARM AND VOICE ANNOUNCEMENT FUNCTION

[75] Inventor: Naoki Takahashi, Futsusa, Japan

[73] Assignee: Casio Computer Co., Ltd., Tokyo, Japan

[21] Appl. No.: 244,777

[22] Filed: Mar. 17, 1981

[30] Foreign Application Priority Data

Mar. 18, 1980 [JP] Japan ..... 55-33381

[51] Int. Cl.[3] ..... G04B 21/08

[52] U.S. Cl. ..... 368/63; 368/251

[58] Field of Search ..... 368/63, 274, 250, 251; 364/900, 705, 710; 365/45; 179/1 SA, 1 SM

[56] References Cited

U.S. PATENT DOCUMENTS

| | | | |
|---|---|---|---|
| 3,632,880 | 1/1972 | Goldschein et al. | 368/63 X |
| 3,878,738 | 4/1975 | Ichikawa et al. | 368/274 X |
| 3,919,834 | 11/1975 | Murakami et al. | 368/63 |
| 3,998,045 | 12/1976 | Lester | 368/63 |
| 4,104,865 | 8/1978 | Sasaki | 368/251 X |
| 4,280,209 | 7/1981 | Mooney | 368/251 X |
| 4,318,188 | 3/1982 | Hoffmann | 365/45 |

*Primary Examiner*—Ulysses Weldon

*Attorney, Agent, or Firm*—Frishauf, Holtz, Goodman and Woodward

[57] ABSTRACT

An electronic timepiece with alarm function includes a voice code memory for storing voice codes corresponding to externally coupled voices in accordance with write instruction signals corresponding to respective alarm times. The voice code memory includes a plurality of memory regions, and new voice codes are stored in a memory region immediately adjacent to the memory region in which voice codes are already stored. The voice codes read out from the voice code memory at the arrival of a predetermined alarm time are decoded for coupling to a sound producing unit to produce sound corresponding to the read out voice codes.

2 Claims, 2 Drawing Figures

ELECTRONIC TIMEPIECE WITH ALARM AND VOICE ANNOUNCEMENT FUNCTION

BACKGROUND OF THE INVENTION

This invention relates to an electronic alarm timepiece with alarm function, in which alarm voices are externally coupled and reproduced at the arrival of predetermined alarm times.

Recent electronic timepieces have been greatly advanced in versatility, and those having alarm functions and timer functions have been in use. The alarm function is provided for informing of the arrival of a given time, and usually a monotone sound at a predetermined frequency or a predetermined piece of music is produced at the arrival of an alarm time. However, the monotone sound or piece of music is selected by the manufacturer, so that it sometimes fails to meet the taste of the user, or the user is soon bored. Another difficiency is that the alarm sound does not inform of what is scheduled to be done at the alarm time, and the user has to memorize what is scheduled to be done at each preset alarm time.

SUMMARY OF THE INVENTION

The object of the invention is to provide an electronic timepiece with alarm function, with which a voice saying what is scheduled to be done can be recorded in a memory such as a RAM (Random Access Memory) and reproduced at the scheduled alarm time so that the user can be informed of what to do at that time, and also with which the memory regions of the memory can be effectively used.

According to the invention, an electronic timepiece with an alarm function and voice announcement function comprises time count means for counting reference signals to obtain time-data; alarm time storing means coupled to the time count means for storing a plurality of alarm time data and for outputting first and second alarm coincidence signals when a coincidence occurs between the stored alarm time data and the time data obtained by said time count means; and voice producing means coupled to the alarm time storing means and responsive to the first and second alarm coincidence signals for producing a voice announcement which is initially stored. The voice producing means comprises voice converting means for converting externally applied voice sounds to voice codes; voice code storing means for sequentially storing the voice codes corresponding to a given voice announcement in response to address designation signals; voice signal outputting means coupled to said voice code storing means for reading out voice codes from the voice code storing means responsive to the outputting of an alarm coincidence signal to produce a voice announcement; final address storing means for storing a final address of the voice codes corresponding to the given voice announcement which are read out from said voice code storing means when an alarm coincidence signal is outputted; and address control means for effecting an address designation with respect to the voice code storing means corresponding to the address following the final address stored in the final address storing means for enabling outputting of the voice codes.

Since according to the invention voices are externally recorded in correspondence to a plurality of alarm times and reproduced at the arrival of these alarm times, the user can be informed of what is scheduled at the alarm time by the alarm sound produced at that time. In addition, any blank memory region in the memory without any voice data recorded therein between adjacent memory regions where voice data for respective scheduled alarm times are recorded can be eliminated. It is thus possible to provide a timepiece with alarm function, with which the most effective use of the memory capacity can be made.

DETAILED DESCRIPTION OF THE PREFERRED EMBODIMENTS

Figure 1A:
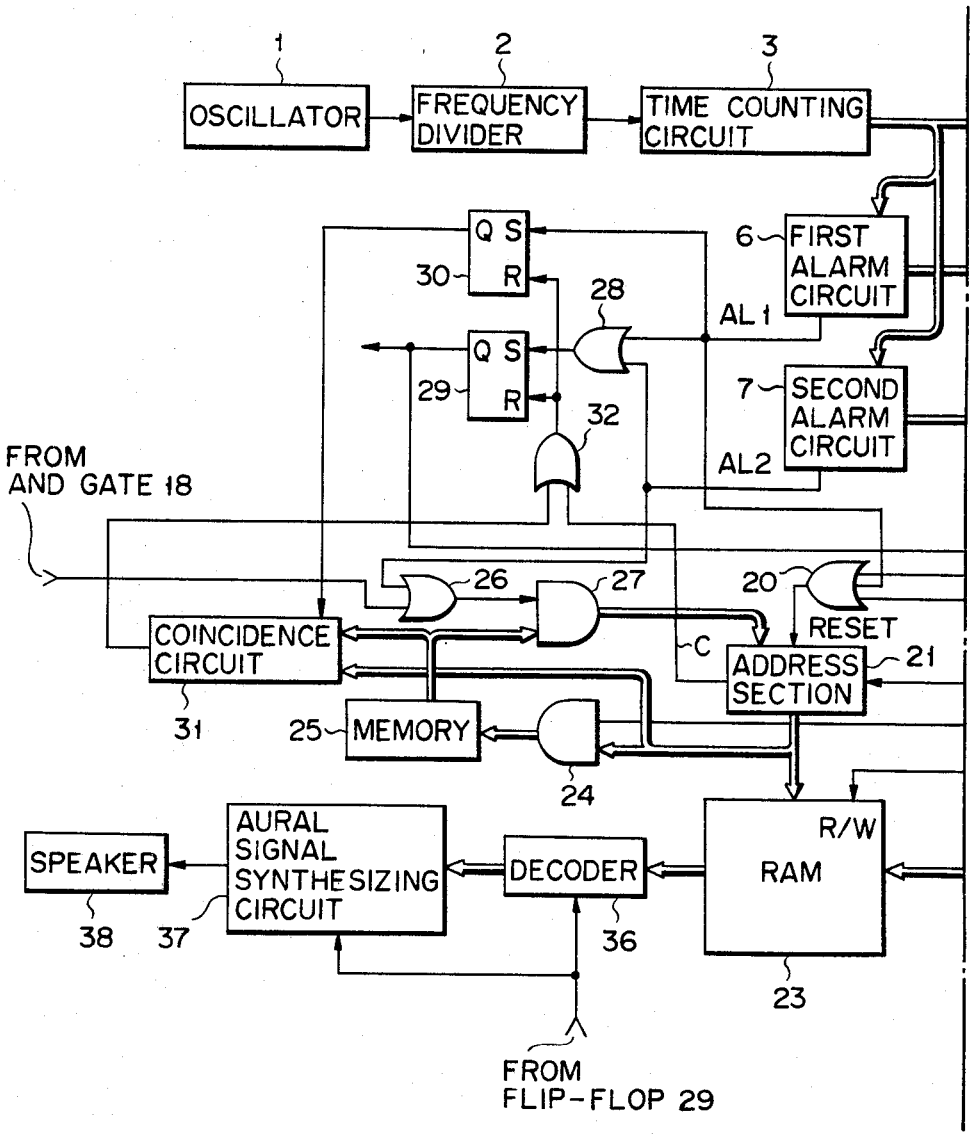
FIGS. 1A and 1B, taken together, illustrate a block circuit diagram showing an embodiment of an electronic timepiece with alarm function according to the invention.
Figure 1B:
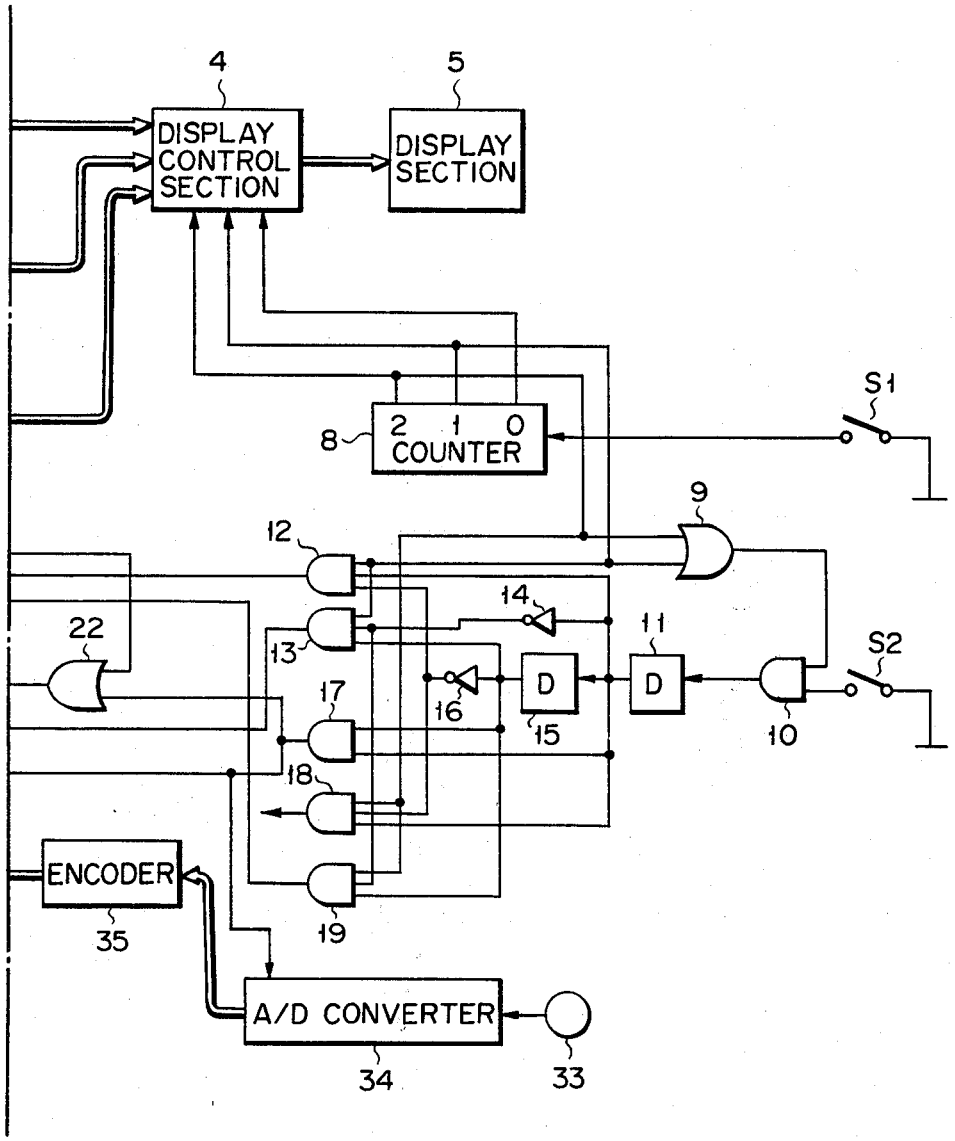

FIGS. 1A and 1B show the circuit construction of an electronic timepiece with alarm function. An oscillator 1 generates a reference clock signal which is coupled to and frequency divided by a frequency divider 2 to obtain a signal having a period of one second. This one second signal is supplied to a time counting circuit 3 and counted therein. The time counting circuit 3 provides time count data such as hour, minute and second data on the basis of the one second signal mentioned above. The time count data is fed through a display control section 4 to a display section 5 for analog or digital display. This data is also fed to first and second alarm circuits 6 and 7 in which desired alarm time data are preset. The first and second alarm circuits 6 and 7 include respective coincidence circuits (not shown) which generate an alarm signal $AL_1$ or $AL_2$ as a single pulse signal when they detect the coincidence of the aforementioned time count data and preset alarm time data. The preset alarm time data in the first and second alarm circuits 6 and 7 are provided through the display control section 4 to the display section 5 for analog or digital display.

A switch $S_1$ is a display mode selection switch, and a signal generated when it is operated is coupled to a scale of 3 mode counter 8, which changes its content to "0", "1", "2", "0", . . . every time the switch operation signal from the switch $S_1$ is coupled and provides signal "1", "1", "2", "0", . . . corresponding to its prevailing content as a display mode signal to the display control section 4. When the content of the mode counter 8 is set to "0", an ordinary time display mode in which the display control section 4 couples the time count data from the time counting circuit 3 to the display section 5 for display therein is selected. When the mode counter circuit is set to "1", a first alarm time display mode in which the alarm time data in the first alarm circuit 6 is coupled through the display control section 4 to the display section 5 for display is selected. When the mode counter content is set to "2", a second alarm time display mode in which the alarm time data in the second alarm circuit 7 is coupled through the display control section 4 to the display section 5 for display is selected.

The signals "1" and "2" of the mode counter 8 are coupled as an enable signal through an OR gate 9 to an AND gate 10. Thus, when a recording switch $S_2$ is operated in the first or second alarm time display mode, the key operation signal from the switch $S_2$ is coupled through the AND gate 10 to a delay circuit 11. The delay circuit 11 delays the switch operation signal from the recording switch $S_2$ for a predetermined period of time. The signal "1" of the mode counter 8 is also coupled to AND gates 12 and 13, and the output signal from the delay circuit 11 is coupled directly to the AND gate 12 and also coupled through an inverter 14 to the AND gate 13. The output of the delay circuit 11 is further coupled to a delay circuit 15. The delay circuit 15 delays the output signal of the delay circuit 11, and its output signal is coupled through an inverter 16 to the AND gate 12 and is also coupled directly to the AND gate 13. Thus, when the switch $S_2$ is operated while the mode counter 8 is set to "1", an output of one-shot is provided from the AND gate 12 from the rising of the output signal of the delay circuit 11 till the falling of the output signal of the inverter 16 (i.e., the rising of the output signal of the delay circuit 15). Also, since the output signals of one-shot of the delay circuits 15 and 11 are coupled to the AND gate 13, when the switch $S_2$ is brought from the operated state to the non-operated state an output is provided from the AND gate 13 from the rising of the output signal of the inverter (i.e., the falling of the output signal of the delay circuit 11) till the falling of the output signal of the delay circuit 15. The output signals of the delay circuits 11 and 15 are also coupled to an AND gate 17, so that an output signal is obtained from the AND gate 17 while both the delay circuits 15 and 11 are providing their outputs. When the content of the mode counter 8 is "2", i.e., in the second alarm time display mode, the signal "2" of the mode counter 8 is coupled to AND gates 18 and 19. To the AND gate 18, like the AND gate 12, the output signal from the delay circuit 11 and the output signal from the delay circuit 15 through the inverter 16 are coupled, so that when the switch $S_2$ is operated in the second alarm display mode, a single pulse signal is provided from the AND gate 18. To the AND gate 19, like the AND gate 13, the output signal from the delay circuit 11 through the inverter 14 and the output signal from the delay circuit 15 are coupled, so that when the switch $S_2$ is brought from the operated state to the non-operated state a pulse signal is provided from the AND gate 19.

The signal provided from the AND gate 12 is coupled through the OR gate 20 to an address section 21 including an address counter (not shown) to reset the content thereof. The address section 21 is rendered operative when the output signal of the AND gate 17 is coupled as an operation command signal through an OR gate 22, and the content of the address counter is incremented by "+1" as each clock pulse signal at a predetermined frequency is provided from the frequency divider 2 while the AND gate 17 is providing the output signal. The content of the address section 21 is coupled as address designation data to a RAM 23. Thus, the specified address of the RAM 23 is progressively shifted every time the content of the address section 21 is changed by "+1". The content of the address section 21 is preset in an address memory 25 through an AND gate 24. The address data preset in the address memory 25 is preset in the address section 21 again through an AND gate 27, to which the output signal from the AND gate 18 is coupled as an enable signal. The output signal from the AND gate 19 is coupled as reset signal through the OR gate 20 to the address section 21.

The alarm signal $AL_1$ provided from the first alarm circuit 6 mentioned above is coupled through the OR gate 20 to the address section 21 to reset the content thereof, and it is also coupled to the set side input terminal S of an RS flip-flop 30 and further through an OR gate 28 to the set side input terminal of an RS flip-flop 29. The set signal of the flip-flop 29 is coupled as an operation command signal through the OR gate 22 to the address section 21. The set signal of the flip-flop 30 is coupled as an operation command signal to a coincidence circuit 31, to which the address data from the address section 21 and the address data preset in the address memory 25 are coupled. When the coincidence circuit 31 detects the coincidence of the address data in the address section 21 and the address data in the address memory 25, it generates a single pulse as a coincidence signal which is coupled through an OR gate 32 to the reset input terminals R of the flip-flops 29 and 30 to reset these flip-flops.

The alarm signal $AL_2$ provided from the second alarm circuit 7 is coupled to the OR gate 28 and also coupled as an enable signal through an OR gate 26 to an AND gate 27. A carry signal C provided from the address counter of the address section 21 is coupled through an OR gate 32 to the reset input terminals R of the flip-flops 29 and 30.

Designated at 33 is a microphone provided in the timepiece. A voice signal provided from the microphone 33 is coupled to an A/D (analog/digital) converter 34. The A/D converter 34 converts the voice signal from the microphone into a digital voice signal which is coupled to an encoder 35. The encoder 35 encodes the digital voice signal into data representing the interval, volume, etc., and this voice code is coupled to the RAM 23. The A/D converter 34 and encoder 35 are rendered operative when the recording signal from the AND gate 17 is coupled as an operation command signal to them. The RAM 23 receives the recording signal from the AND gate 17 at its read/write input terminal W/R, and it is given a write designation when the recording signal is at a binary logic level "1" and a read designation when the signal is at a level "0". The write or read out operation of the RAM 23 is done in synchronism to the clock signal (not shown) provided from the frequency divider 2 and with respect to a memory region, whose address is specified by the address section 21.

The voice code written in the RAM 23 is read out to a decoder 36. The operation in the decoder 36 is converse to that in the encoder 35, and the decoded signal output is coupled to an alarm signal synthesizing circuit 37. The alarm signal synthesizing circuit 37 synthesizes a voice signal from the decoded signal output of the decoder 36, and the voice signal thus obtained is coupled to a loudspeaker 38 for producing alarm sound. The decoder 36 and alarm signal synthesizing circuit 37 are rendered operative when the set signal of the flip-flop 29 is coupled as an operation command signal to them.

Now, the operation of the electronic timepiece having alarm function having the above construction will be described. When the content of the mode counter 8 is "0", the time count data obtained in the time count circuit 3 is fed through the display control circuit 4 to the display section 5 for display as ordinary time data. When the mode selection switch $S_1$ is operated in the ordinary time data display mode, its content is incremented by "1", so that the signal "1" is provided from the mode counter 8 and coupled to the display control circuit 4. Thus, the alarm time data preset in the first alarm circuit 6 is coupled through the display control circuit 4 to the display section 5 for display.

Now, the case of recording an alarm voice (for instance "meeting") corresponding to the alarm time (for instance "10:30 a.m.") preset in the first alarm circuit 6 in the first alarm time display mode will be described. When the recording switch $S_2$ is operated in the "1" state of the mode counter 8, its operation signal is coupled through the AND gate 10, which has been enabled by the signal "1" of the mode counter 8, to the delay circuit 11, so that the delay circuit 11 provides the output signal after a predetermined delay time. The output signal of the delay circuit 11 is coupled to the delay circuit 15, which provides a delayed output signal after a predetermined delay time. Thus, the single pulse signal is provided from the AND gate 12 to clear the address counter in the address section 21. While the recording switch $S_2$ is being operated, during which time the output signals of the delay circuits 11 and 15 are coupled to the AND gate 17, the AND gate 17 provides the output signal while the delay circuits 11 and 15 are providing the output signals. With the appearance of the output signal from the AND gate 17, the A/D converter 33 and encoder 34 are rendered operative, while the RAM 23 is given a write designation. Further, the address section 21 is rendered operative to cause counting operation of the address counter which has been cleared as mentioned earlier. In this state, by pronouncing the alarm voice ("meeting") which is the content to be executed at the alarm time preset in the first alarm circuit 6, to the microphone 32, the microphone 32 produces a voice signal which is converted through the A/D converter 34 into the digital voice signal, which is in turn encoded through the encoder 35 before being coupled to the RAM 23. The voice code coupled to the RAM 23 is written therein in the memory region thereof, whose address is specified by the address data from the address section 21. Since the content of the address counter in the address section 21 is cleared prior to the recording operation by the output signal from the AND gate 12, at the time of the start of the recording operation the first address of the RAM 23 is first specified, and then the specified address of the RAM 23 is progressively shifted every time the content of the address counter in the address section 12 is incremented by "+1", whereby the voice codes representing the voice "meeting" are written in the memory region of the specified addresses. When the pronounciation of the sound "meeting" is ended, the recording switch $S_2$ is released, whereupon a single pulse signal is provided from the AND gate 13. By this pulse signal the AND gate 24 is enabled, whereby the content of the address section 21, i.e., the address data therein at the time of the releasing of the switch $S_2$, is coupled through the AND gate 24 to the address memory 25 and registered therein.

When the mode selection switch $S_1$ is subsequently operated to set the content of the mode counter 8 to "2", the signal "2" is provided therefrom and coupled to the display control section 4. Thus, the display mode is switched over to the second alarm time display mode, and the alarm time data preset in the second alarm circuit 7 is coupled through the display control section 4 to the display section 5. If an alarm voice (for instance "A telephone call for Mr. A") corresponding to the alarm time (for instance "3:30 p.m.") preset in the second alarm circuit 7 is to be recorded in the second alarm time display mode, the recording switch $S_2$ is operated again. The switch operation signal thus provided from the switch $S_2$ is coupled through the AND gate 10, which has been enabled by the signal "2" of the mode counter 8, to the delay circuit 11, and the delay circuit 11 provides the output signal after a predetermined delay time. The output signal of the delay circuit 11 is coupled to the delay circuit 15. Thus, the aforementioned case with the AND gate 12, the AND gate 18 provides a single pulse signal, which is coupled as an enable signal through the OR gate 26 to the AND gate 27, whereby the address data set in the address memory 25 is coupled through the AND gate 27 to the address section 21 and preset therein. The address data that is set in the address section 21 this time is what has been in the address counter in the address section 21 at the time of the end of the recording of the alarm voice ("meeting") corresponding to the alarm time ("10:30 a.m.") set in the first alarm circuit 6. Since this address data is coupled to the RAM 23, the RAM 23 is given address designation at this time from the address next to the memory region in which the voice codes for the alarm voice "meeting" are recorded. With the appearance of the recording signal from the AND gate 17, the RAM 23, A/D converter 34, encoder 35 and address section 21 are set to the recording enable state as described previously. By pronouncing "A telephone call for Mr. A" to the microphone 32 in this state, the voice codes regarding the voice "A telephone call for Mr. A" are recorded in the RAM 23 in a memory region thereof next to the region in which the voice codes for "meeting" are recorded. When the recording is ended, the recording switch $S_2$ is released, whereupon a single pulse is provided from the AND gate 19 and coupled through the OR gate 20 to the address section 21 to clear the content thereof.

When the alarm time ("10:30 a.m.") set in the first alarm circuit 6 is reached, the alarm signal $AL_1$ as a single pulse is provided from the first alarm circuit 6, and it is coupled through the OR gate 20 to the address section 21 to clear the content thereof. While the content of the address section 21 is cleared when the recording of the voice corresponding to the alarm time set in the second alarm circuit 7 is ended as mentioned previously, in case if the recording of the voice corresponding to the alarm time of the second alarm circuit 7 is not made, the last address data at the time of the recording of the voice corresponding to the alarm time of the first alarm circuit 6 remains memorized in the address section 21. With the appearance of the alarm signal $AL_1$ the content of the address section 21 is thus cleared for specifying the first address in the RAM 23. The alarm signal $AL_1$ is also coupled through the OR gate 28 to the flip-flop 29 to set this flip-flop. Thus, the flip-flop 29 provides the set signal which is coupled through the OR gate 22 to the address section 21, whereby the content of the address counter in the address section 21 is progressively incremented by "+1" after another. Since the output of the AND gate 17 is at the binary logic level "0", the RAM 23 is given the read designation, while the address section 21 is given address progressive designation from the first address, whereby the voice codes regarding the voice "meeting" are progressively read out from the memory region in which they are recorded. As these voice codes are read out, they are successively coupled through the decoder 36, alarm signal synthesizing circuit 37, these circuits being set to the operative state by the set signal of the flip-flop 29. Thus, they are each decoded in the decoder 36 and inverted in the alarm signal synthesizing circuit 37 into a voice signal which is coupled to the loudspeaker 38 for producing sound. In this way, the alarm voice sound "meeting" is produced at the alarm time "10:30 a.m.". The alarm signal $AL_1$ mentioned above is further coupled to the set input terminal S of the flip-flop 30 to set this flip-flop, and the set signal therefrom is coupled as an operation command signal to the coincidence circuit 31. The coincidence circuit 31 is thus rendered operative for detecting the coincidence of the address data from the address section 21 and the address data from the address memory 25. When the coincidence circuit 31 detects the coincidence of data, i.e., when the memory region in the RAM 23 in which the voice codes regarding the voice "meeting" has been entirely specified, a coincidence signal is provided from the circuit 31 and coupled through to the reset input terminal R of the flip-flop 29 to reset this flip-flop, thus stopping the sound producing operation.

When the alarm time ("3:30 p.m.") set in the second alarm circuit 7 is reached, the alarm signal $AL_2$ is provided from the second alarm circuit 7, and it is coupled through the OR gate 28 to the flip-flop 29 to set this flip-flop and also coupled through the OR gate 26 to the AND gate 27 to enable this AND gate. With the setting of the flip-flop 29 the address section 21, encoder 35 and alarm signal synthesizing circuit 37 are set to the operative state, while the address data in the address memory 25 is coupled through the AND gate 27 to the address section 21 and preset therein. With the address section 21 rendered operative, the RAM 23 is given address designation for addresses after the address specified by the address data preset in the address section 21. Thus, the voice codes regarding the voice "A telephone call for Mr. A" are read out from the RAM 23, and the voice sound "A telephone call for Mr. A" is produced from the loudspeaker 37. When the carry signal is provided from the address section 21, it is coupled through the OR gate 32 to the reset input terminal R of the flip-flop 29, thus stopping the sound producing operation.

As has been described in the foregoing according to the invention, what is scheduled to be done at an alarm time is informed of by the voice sound at the alarm time. In addition, since the voice corresponding to the alarm time set in the second alarm circuit 7 can be recorded in a recording region immediately following the recording region in which the voice corresponding to the alarm time set in the first alarm circuit 6 is recorded, that is, since any blank memory region in the RAM 23 without any voice codes recorded therein between adjacent memory regions where voice codes are recorded can be eliminated, it is possible to minimize the recording capacity of the RAM 23, that is, make the most effective use of the RAM capacity.

While in the above embodiment of the electronic timepiece with alarm function two alarm circuits have been provided, it is possible to provide three or more alarm circuits. Further, while the above embodiment has applied to the electronic timepiece having the alarm function of producing an alarm sound at a preset alarm time, the invention is also applicable for use in connection with a time informing function of producing a sound at the exact time corresponding to an integral number on a time keeper or a calendar alarm function of producing a sound on a preset day of the month, year, etc.

What is claimed is:

1. An electronic timepiece with an alarm function and voice announcement function, comprising:

time count means for counting reference signals to obtain time-data;

alarm time storing means coupled to said time count means for storing a plurality of alarm time data and for outputting first and second alarm coincidence signals when a coincidence occurs between the stored alarm time data and the time data obtained by said time count means; and voice producing means coupled to said alarm time storing means and responsive to said first and second alarm coincidence signals for producing a voice announcement which is initially stored, said voice producing means comprising:

voice converting means for converting externally applied voice sounds to voice codes;

voice code storing means coupled to said voice converting means for sequentially storing the voice codes corresponding to a given voice announcement in response to address designation signals;

voice signal outputting means coupled to said voice code storing means and to said alarm time storing means for reading out voice codes from said voice code storing means responsive to the outputting of an alarm coincidence signal to produce a voice announcement;

final address storing means for storing a final address of the voice codes corresponding to said given voice announcement which are read out from said voice code storing means when an alarm coincidence signal is outputted; and address control means for effecting an address designation with respect to said voice code storing means corresponding to the address following said final address stored in said final address storing means for enabling outputting of said voice codes.

2. The electronic timepiece of claim 1, wherein said voice code storing means comprises a RAM (Random Access Memory).

* * * * *